US005884452A

United States Patent [19]

Bois

[11] Patent Number: 5,884,452

[45] Date of Patent: Mar. 23, 1999

[54] METHOD AND A MACHINE FOR MAKING PACKAGING BAGS USING A FLEXIBLE FILM AND A PACKAGE BAG OBTAINED THEREBY

[75] Inventor: Henri Bois, Neuilly-sur-Seine, France

[73] Assignee: Flexico-France, Henonville, France

[21] Appl. No.: 895,372

[22] Filed: Jul. 16, 1997

[30] Foreign Application Priority Data

Jul. 16, 1996 [FR] France ..... 96 08849

[51] Int. Cl.[6] ..... B65B 61/18

[52] U.S. Cl. ..... 53/412; 53/451; 53/551; 53/133.4

[58] Field of Search ..... 53/451, 551, 410, 53/412, 133.4, 133.2; 493/213

[56] References Cited

U.S. PATENT DOCUMENTS

| | | | |
|---|---|---|---|
| 4,532,754 | 8/1985 | Hokanson | 53/133.4 |
| 4,709,533 | 12/1987 | Ausnit . | |
| 4,812,074 | 3/1989 | Ausnit et al. | 493/213 |
| 4,894,975 | 1/1990 | Ausnit . | |
| 4,907,393 | 3/1990 | Omori et al. | 53/410 |
| 4,909,017 | 3/1990 | McMahon et al. | 53/412 |
| 5,036,643 | 8/1991 | Bodolay | 493/213 |
| 5,247,781 | 9/1993 | Runge | 53/133.4 |
| 5,400,568 | 3/1995 | Kanemitsu et al. | 53/133.4 |
| 5,461,845 | 10/1995 | Yeager | 53/451 |
| 5,564,259 | 10/1996 | Stolmeier | 53/410 |

FOREIGN PATENT DOCUMENTS 2 583 018 5/1990 France .

*Primary Examiner*—John Sipos
*Assistant Examiner*—John Paradiso
*Attorney, Agent, or Firm*—Schwartz & Weinrieb

[57] ABSTRACT

The present invention relates to a method of automatically forming, filling, and closing reclosable packaging bags based on a film of flexible material, e.g. a thermoplastic material, provided with added-on strips and in particular complementary male and female slideway closure strips, the method comprising the steps consisting in: providing a feed of flexible film; providing a feed of strips; and fixing the strips on the film by heat sealing; wherein: the step of feeding strips consists in providing a tape of flexible material carrying the complementary strips; and the step of fixing consists in heat sealing the tape onto the film prior to feeding the resulting assembly to the tube-forming neck of an automatic machine for forming, filling, and closing packaging bags. The invention also relates to machines for implementing the method and to the resulting bags.

30 Claims, 7 Drawing Sheets

1
1a
1b
100
102
103
104
105
110
112
150
152
160
170

1
1a
1b
100
102
103
104
105
110
112
150
152
170
172

1
1d
100b
100
222
220
210
100a
110,112
200
110, 112
100

METHOD AND A MACHINE FOR MAKING PACKAGING BAGS USING A FLEXIBLE FILM AND A PACKAGE BAG OBTAINED THEREBY

FIELD OF THE INVENTION

The present invention relates generally to packaging bags, and more particularly to apparatus for automatically forming, filling, and closing reclosable packaging bags format from flexible films, for example of thermoplastic material, and fitted with shaped add-on strips, in particular complementary male and female slideway closure strips.

BACKGROUND OF THE INVENTION

Numerous machines already exist for performing the aforenoted packing operation.

Examples thereof can be found in documents U.S. Pat. No. 4,894,975 and U.S. Pat. No. 4,709,533.

As shown in accompanying FIG. 1, automatic machines are known for forming, filling, and closing packaging bags formed from films of thermoplastic material and fitted with add-on strips and comprising:

- a tube-forming neck 10 which is fed with film 1 in a planar state from a suitable pay-out means, and which outputs the film shaped into a tube 2;
- a filling chute 20 which opens out into the forming neck 10 and consequently into the tube 2;
- means 50 for feeding strips 3;
- means 30 for performing longitudinal heat sealing 31 so as to fix the strips 3 on the longitudinal margins of the film 1 and to seal these longitudinal margins of the films together in order to close the tube 2 longitudinally; and
- means 40 suitable for sequentially generating a first transverse line of heat sealing 42 before a product is inserted into the tube 2 by means of the filling chute 20, and then a second transverse line of sealing 44 once the product has been inserted into the tube 2, thereby closing the package around the product.

State of the art machines of the kind shown in accompanying FIG. 1 have already exhibited good service.

Nevertheless, they are not completely satisfactory.

In particular, installing the closure strips often turns out to be very difficult and requires regular attention, thereby slowing down the manufacturing process. Also, such installation requires major modifications whenever it is desired to transform conventional automatic machines for forming, filling, and closing packaging bags formed from films of thermoplastic materials.

OBJECTS AND SUMMARY OF THE INVENTION

Consequently, an object of the present invention is to improve known automatic machines for forming, filling, and closing reclosable packaging bags formed from flexible film material.

According to the present invention, this object is achieved by an automatic machine for forming, filling, and closing reclosable packaging bags formed from a film of flexible material, for example of thermoplastic material, the film being provided with add-on strips, in particular complementary male and female slideway closure strips, the machine comprising:

- flexible film feed means;
- strip feed means; and
- fixing means for fixing the strips onto the flexible film by heat sealing;

wherein:

- the strip feed means are adapted to deliver a tape of flexible material carrying the complementary strips; and
- the fixing means are adapted to heat seal the tape onto the film prior to the resulting assembly being fed to a tube-forming neck.

In a preferred variant embodiment, the tape carrying the complementary strips is folded into a U-shape, and the complementary strips are mutually engaged while the tape is being fixed on the film.

In this context, according to another advantageous characteristic of the invention, the machine comprises:

- means suitable for heat sealing one wing of the tape provided with the closure strips onto a first length of the film;
- means suitable for folding the film; and
- means suitable for heat sealing the second wing of the tape onto the second length of the film so as to form a Z-shape at the closure prior to feeding the assembly comprising the film and the tape to the forming neck.

Nevertheless, in another variant of the invention, the tape carrying the closure strips may be in a planar state while it is being heat sealed to the flexible film.

The present invention also provides a method of automatically forming, filling, and closing reclosable packaging bags, and bags obtained by implementing the method.

BRIEF DESCRIPTION OF THE DRAWINGS

Other characteristics, objects, and advantages of the invention will become apparent upon reading the following detailed description with reference to the accompanying drawings, given as non-limiting examples, in which like reference characters designate like or corresponding parts throughout the several views, and wherein.

DETAILED DESCRIPTION OF THE ILLUSTRATED EMBODIMENTS

Figure 1:
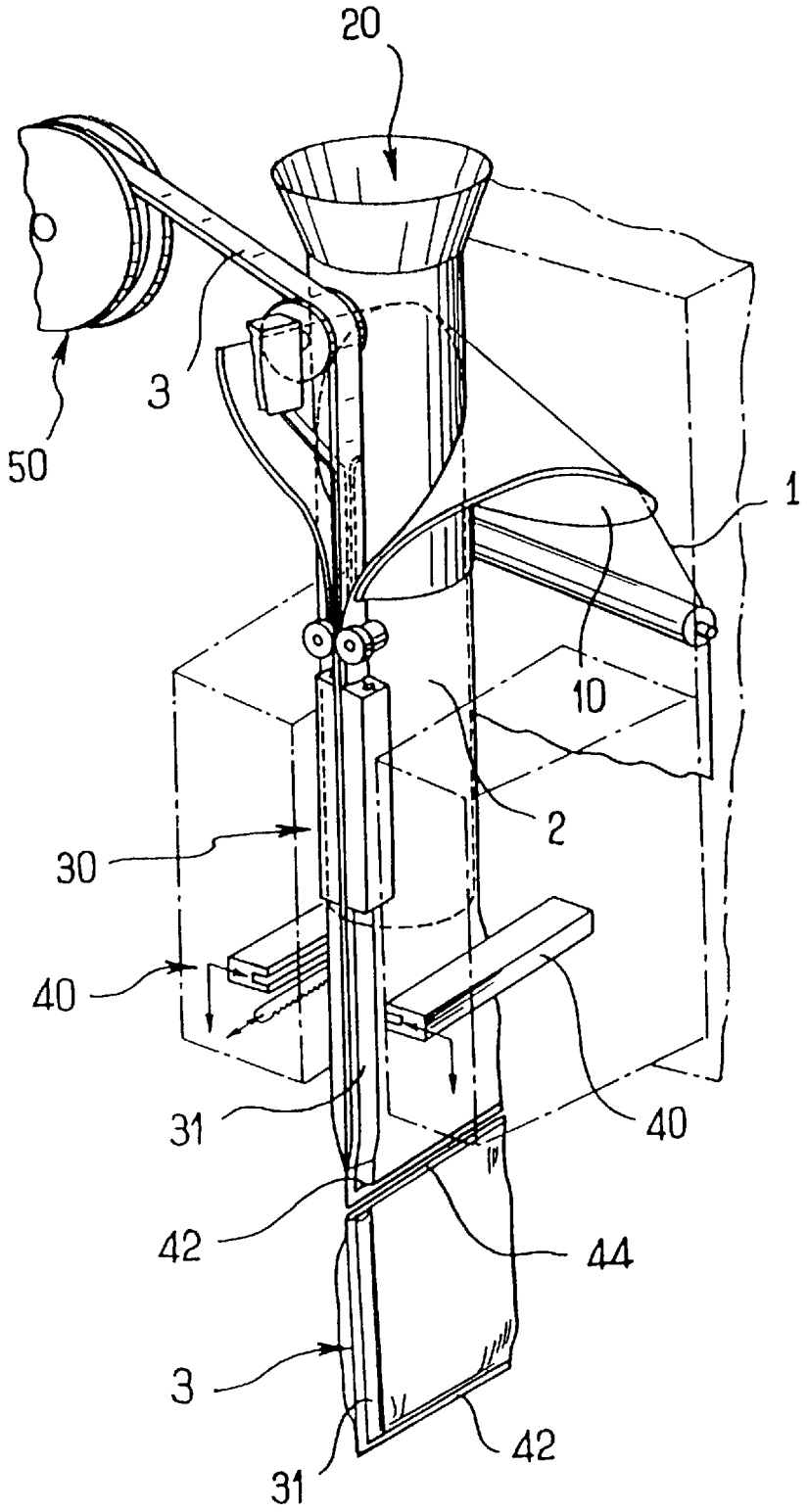
FIG. 1 is described above and is a diagrammatic perspective view of a state of the art machine.

The general structure of the automatic machine for forming, filling, and closing packaging bags of the present invention is comparable to that of prior known machines of the type shown in FIG. 1.

The invention differs from the state of the art as shown in that figure essentially by the fact that the closure strips are not fed to the forming neck and are not fixed on the film at the forming neck, but are fixed on the film upstream from the forming neck.

That is why the general structure of the machine of the present invention is not described below.

The description relates solely to the novel structure of the means for fixing the closure strips on the film.

A first variant embodiment in accordance with the present invention and as shown in FIGS. 2*a* to 2*d* is described initially.

Figures 2A, 2B, 2C, 2D:
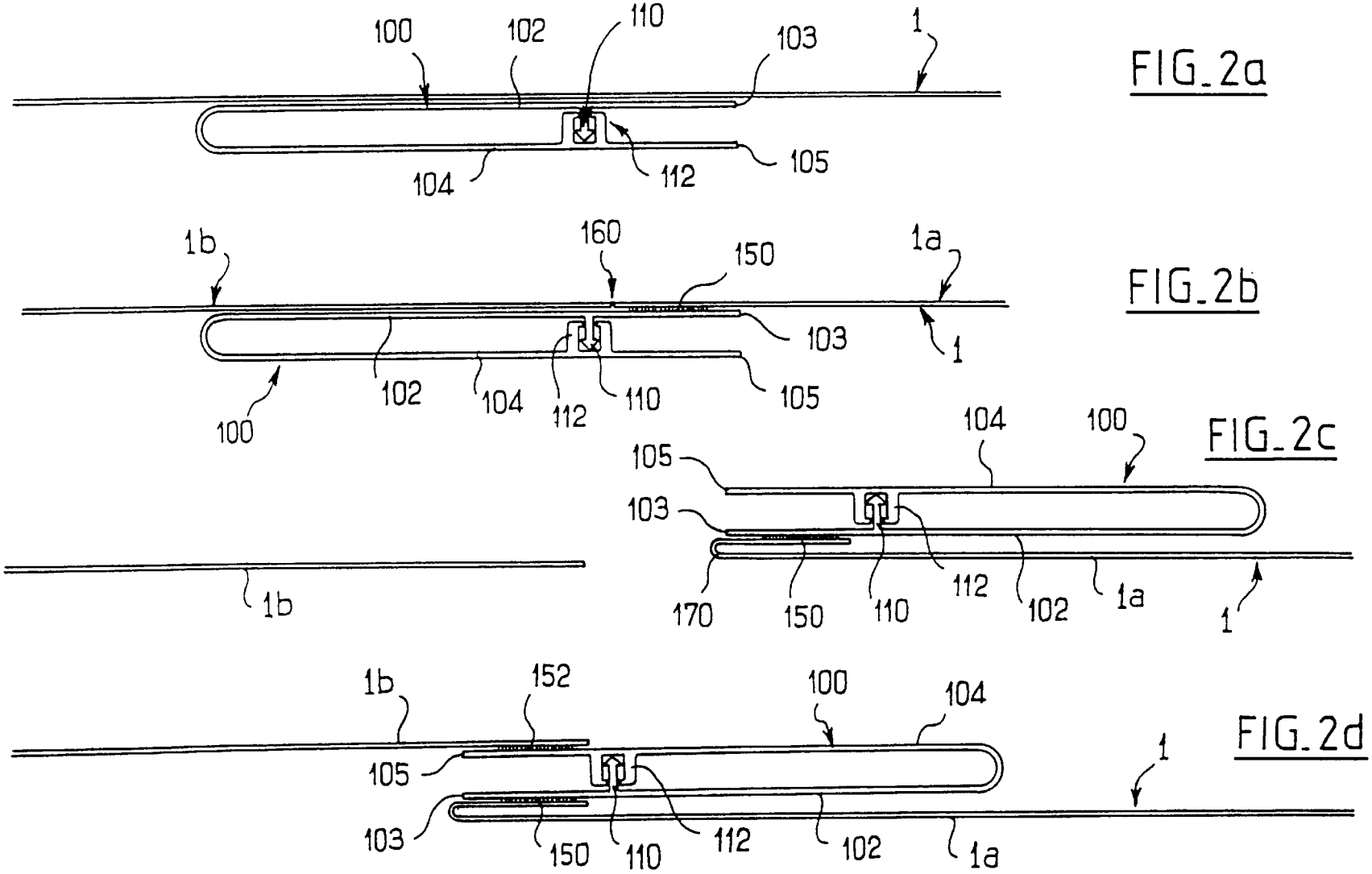
FIGS. 2*a*, 2*b*, 2*c*, and 2*d* are diagrams showing four successive steps in implementing a method in compliance with a first variant implementation of the present invention.

In FIG. 2*a*, there can be seen a flexible film 1 in the planer state as taken from a pay-out spool, for example, and a tape 100 of flexible material which carries the complementary closure strips 110 and 112. More particularly, in the variant embodiment of FIGS. 2*a* to 2*d*, the tape 100 is folded over in a U-shape and the complementary strips 110 and 112 are in mutual engagement when the tape 100 is brought up to the film 1, as shown in FIG. 2*a*.

As shown in FIG. 2*b*, means then perform heat sealing on the wing 102 of the tape 100 that is adjacent to the film 1. In FIG. 2*b*, the zone of sealing between the wing 102 and the film 1 is referenced 150. It will be observed that this zone of sealing 150 is preferably confined to a region situated beyond the strips 110 and 112, that is, between the strips 110 and 112, and the free edges 103, 105 of the wings 102, 104 of the tape 100.

Almost simultaneously with the formation of the heat sealing zone 150, the film 1 is cut longitudinally at 160 in the vicinity of the heat sealing zone 150.

As can be seen in FIG. 2*b*, the cut 160 is preferably formed on the side of the line of heat sealing zone 150 that is further from the opening of the U-shaped tape 100.

After being cut along the line 160, the film 1 is in the form of two lengths: a first length la having the tape 100 fixed thereto by the zone of heat sealing 150, and a second length 1*b* that is separate therefrom.

In the third step shown in FIG. 2*c*, the first length 1*a* of film is folded over through 180° so that the wing 102 of the tape 100 comes to be adjacent to the surface of the length la that is opposite to the surface with which it was previously adjacent.

In the fourth step shown in FIG. 2*d*, the second length 1*b* is brought up to the margin 105 of the second wing 104 of the tape 100 and is heat sealed to the wing 104 by means of a zone of heat sealing referenced 152.

It will be observed that in this state, the U-shaped tape 100 in combination with the 180° fold 170 forms a Z-shape.

The assembly comprising the film 1 plus the tape 100 as shown in FIG. 2*d* can then be fed to a forming neck comparable to that shown in FIG. 1 so as to shape the film into a tubular state and form and close bags from the tubular film by longitudinal and transverse heat sealing means like the means referenced 30 and 40 in FIG. 1.

In the variant shown in FIGS. 2*a* to 2*d*, the tape 100 has its outside surface heat sealed to the lengths 1*a* and 1*b* of the film 1. Nevertheless, it is possible to envisage heat sealing the wings 102 and 104 of the tape 100 to the lengths 1*a* and 1*b* of the film by means of their inside surfaces.

In yet another embodiment, it is possible to use two lengths of film 1*a* and 1*b* that are initially separate before bringing up the tape 100, instead of being separated only during the second step by means of the longitudinal line of cut 160.

Figures 3A, 3B, 3C, 3D:
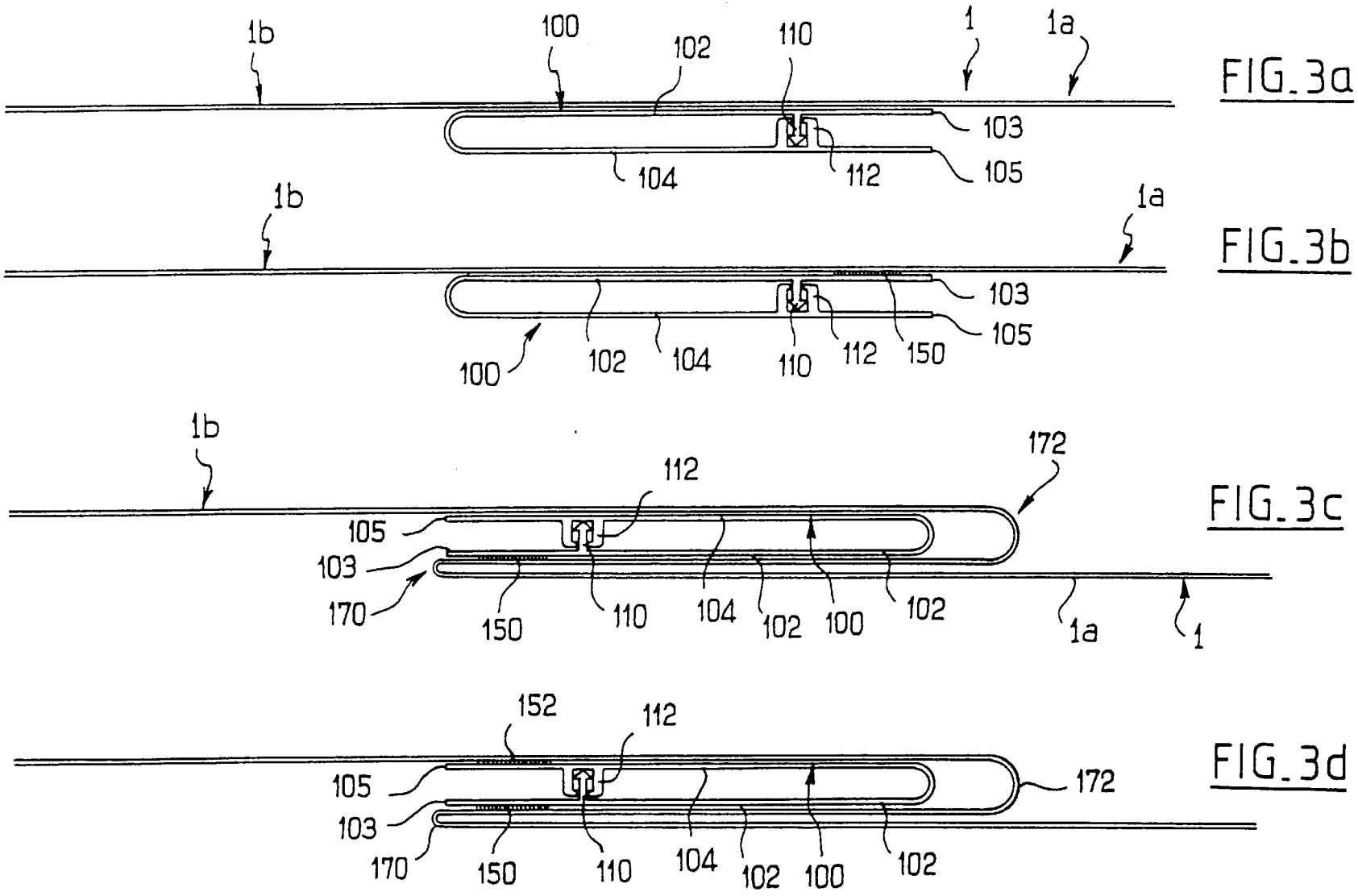
FIGS. 3*a*, 3*b*, 3*c*, and 3*d* show four successive steps of a second variant of a method in accordance with the invention.

A second variant embodiment in accordance with the present invention and as shown in FIGS. 3*a* and 3*d* is described below.

In FIG. 3*a*, there can be seen a tape 100 folded into a U-shape and carrying complementary strips 110 and 112 that are mutually engaged and adjacent to a film 1 by means of one of its wings 102.

During the step shown in FIG. 3*b*, the free end of the wing 102 of the tape 100 is heat sealed at 150 to the film 1, in a manner comparable to that of FIG. 2*b*.

During the step shown in FIG. 3*c*, the film 1 is folded over to form a 180° fold 170 adjacent to the margin 103 of the wing 102 and then around the U-shaped tape 100 by means of a second fold 172 that is also through 180°.

In the step shown in FIG. 3*d*, the second wing 104 of the tape 100 is heat sealed close to its free margin 105 to the now-adjacent second length 1*b* of the film in a heat sealing zone 152.

In this case also, the assembly comprising the film 1 and the tape 100 as obtained in this way is then fed to the tube-forming neck of a conventional machine for forming, filling, and closing bags.

It will be observed that it is preferable to place a thermally insulating spacer between the free ends of the wings 102 and 104 while performing heat sealing 150 and 152 so as to avoid directly sealing the margins 103 and 105 of the wings together; it is also possible to use a tape 100 with an inside surface having a melting point that is higher than that of its outside surface.

The variants shown in FIGS. 4 and 5 differ from those shown in FIGS. 2 and 3 essentially by the fact that the tape 100 carrying the strips 110 and 112 is in the flat state while being sealed onto the film 1.

Figure 4A:
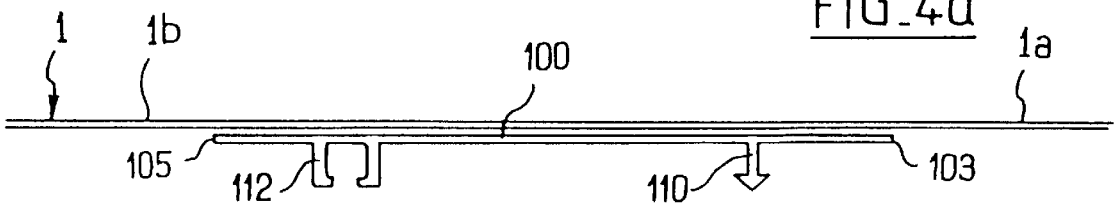
FIGS. 4*a*, 4*b*, and 4*c* show three successive steps of a method in accordance with a third variant of the method of the present invention.

The third variant embodiment as shown in FIG. 4*a* is described below.

Figure 4B:
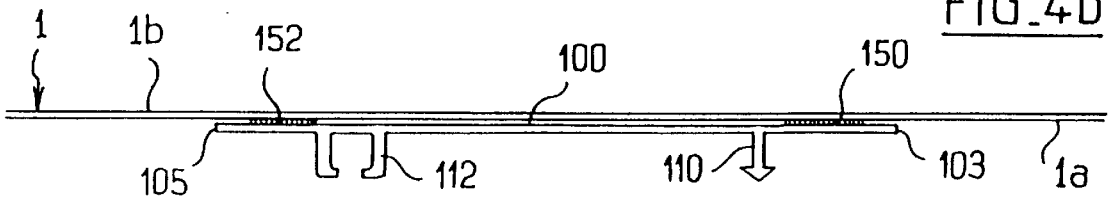

Thus, FIG. 4*a* shows a planar tape 100 fitted with complementary closure strips 110, 112 placed adjacent to a planar film 1, and FIG. 4*b* shows the same planer tape 100 heat sealed to the planar film 1 in the vicinity of its ends, in two zones 150 and 152.

It will be observed that where appropriate the tape 100 could be heat sealed to the film 1 over the entire width of its surface adjacent thereto.

Starting from the state shown in FIG. 4*b*, the assembly comprising the film 1 and the tape 100 can be fed in the flat state to the forming neck, with the strips 110 and 112 being brought progressively into engagement in the forming neck by using the means shown in FIGS. 1 to 6 of document FR-A-2 583 018.

Figure 4C:
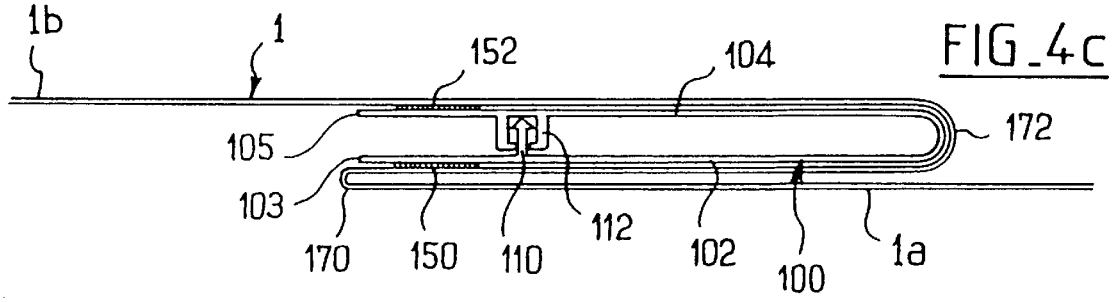

However, in another variant, and as shown in FIG. 4*c*, the assembly comprising the film 1 and the tape 100 as shown in FIG. 4*b* can be given a Z-shaped fold prior to being transferred to the forming neck of a conventional machine for forming, filling, and closing bags. While the film 1 is being folded, it can be seen that the strips 110 and 112 are brought into engagement by the tape 100 being folded over into a U-shape as at 17*d*.

Still more precisely, the film 1 is folded into a Z-shape by means of a first 180° fold 170 adjacent to one of the ends 103 of the wings of the tape 100, and a second 180° fold 172 on the outside of the tape 100 and halfway therealong.

Figure 5A:
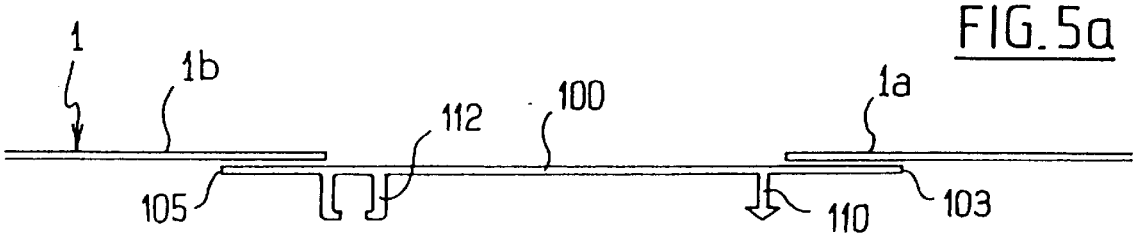
FIGS. 5*a*, 5*b*, and 5*c* show three successive steps of a fourth variant of a method in accordance with the present invention.
Figure 5B:
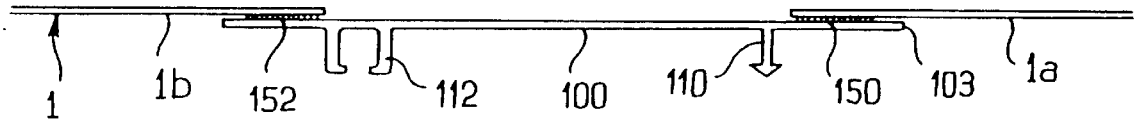
Figure 5C:
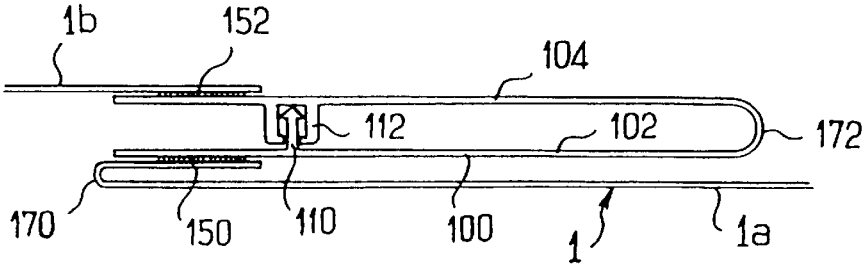

The fourth variant embodiment as shown in FIGS. 5*a* to 5*c* is described below.

This fourth variant embodiment is similar to the third variant shown in FIGS. 4*a* to 4*c* in that the tape 100 is brought up to the film 1 and is heat sealed thereto while in the planar state, as shown in FIGS. 5*a* and 5*b*.

However, unlike the third variant shown in FIGS. 4, in the fourth variant embodiment, the margins 103 and 105 of the tape 100 are fixed to respective different or separate lengths 1*a* and 1*b* of the film 1 as at heat seal zones 150 and 152.

The assembly comprising the two lengths 1*a* and 1*b* of the film 1 interconnected by the planer tape 100 carrying the closure strips 110 and 112 can be conveyed in the planar state to the forming neck of an automatic machine for forming, filling, and closing bags, and then the strips 110 and 112 can be moved progressively towards each other and brought into mutual engagement by the means shown in FIGS. 3 to 6 of document FR-2 583 018, or Z-folding can be performed as shown in FIG. 5*c* by forming a 180° fold 170 in one of the lengths 1*a* or 1*b* of the film 1 so that it is folded over close to the margin 103, 105 of one of the wings 102, 104 of the tape 100, and subsequently, a second fold line 172 is made at a position intermediate the marginal ends 103, 105 of the tape 100.

Starting from this state, the assembly comprising the film 1 and the tape 100 folded into a Z-shape can, in like manner, be fed conventionally to the forming neck of an automatic machine for forming, filling, and closing bags.

The film 1 used in the context of the invention may comply with dispositions known to the person skilled in the art.

The same applies to the closure strips 110 and 112.

Where appropriate, and in a conventional manner, the strips 110 and 112 may be associated with one or more cords included in the tape 100 to facilitate opening packaging bags.

Such cords are intended to cut through the tape 100 and the film 1 when traction is applied to the outside of the strips 110 and 112, and they are well known to the person skilled in the art.

The term "easy open" is commonly applied to them.

Naturally, the present invention is not limited to the particular embodiments described above, but it extends to any variant within its spirit.

In particular, the invention is not limited to forming bags formed from thermoplastic material film.

The invention can also be applied to forming bags formed from flexible film of some other kind, for example aluminum or paper.

Also, although the invention is applicable to films of thermoplastic material provided with complementary male and female slideway closure strips, as described above, the invention is not limited to using that particular type of strip.

The invention extends to any type of strip 110, 112 suitable for being fitted to a packaging film, for example cords integrated in the film to facilitate opening the package, decorative borders, for example colored borders, or indeed graduated borders for identifying the volume of product contained in the package.

Also, the invention is naturally not limited to the particular shape of the complementary strips 110 and 112 shown in the accompanying figures.

Figure 6:
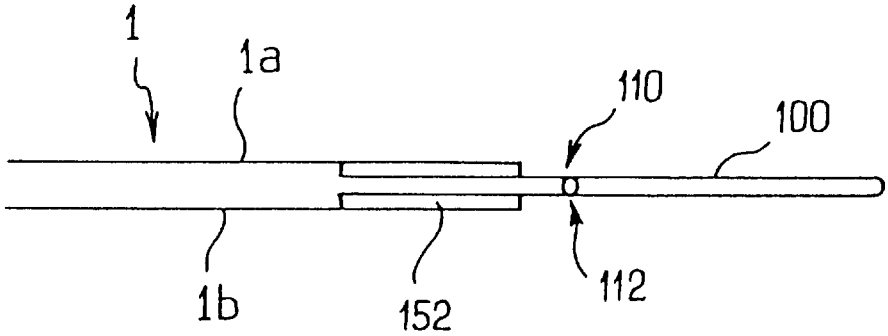
FIGS. 6, 7, and 8 are diagrams of three variant bonds in accordance with the present invention between a film and a tape of flexible material carrying the complementary strips.

FIG. 6 shows a variant embodiment in which the tape 100 is folded into a U-shape during the step of bonding the film 1 to the tape 100 carrying the complementary strips 110, 112, while the film 1 is split into two mutually parallel and substantially adjacent sheets 1*a* and 1*b*. In FIG. 6, the two sheets 1*a* and 1*b* are of identical width. Nevertheless, this condition is not essential.

In FIG. 6, the free ends of the tape 100 are disposed between the free ends of the sheets 1*a* and 1*b*. The heat-sealing zones defined between the sheets 1*a* and 1*b* and the ends of the tape 100 are referenced 150 and 152.

In a variant, it is nevertheless possible to provide for the ends of the tape 100 to be located outside the sheets 1*a* and 1*b*, and not between them.

Figure 7:
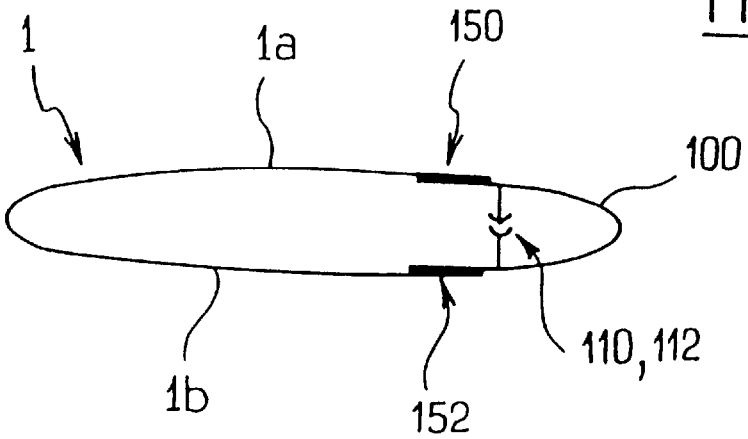

FIG. 7 shows a variant in which the film 1 is not made up of two separate sheets 1*a* and 1*b*, but of a single film that is folded over into a U-shape and whose free ends are fixed respectively to the ends of the tape 100. In FIG. 7, the ends of the film 1 are placed outside the ends of the tape 100, but in a variant they could be placed inside them.

The variant of FIG. 7 requires the film 1 to be cut longitudinally at some arbitrary location in order to allow subsequent insertion in the neck of the machine.

Figure 8:
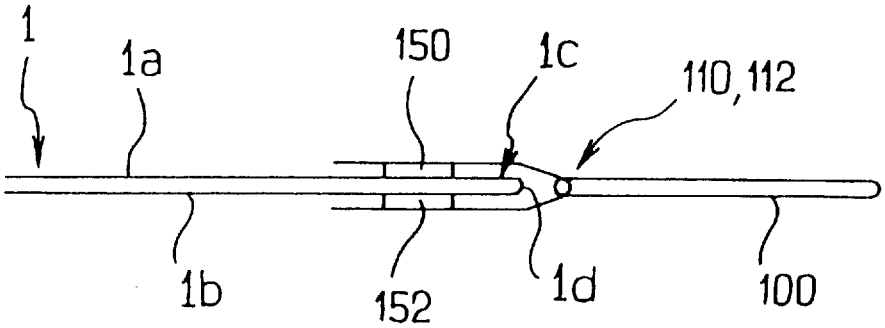

FIG. 8 shows another variant in which the film 1 is folded into a U-shape and the web of the U formed in this way in the film 1 is placed between two wings of the tape 100 which is itself U-shaped. In this position, the film 1 also defines two parallel adjacent sheets 1*a* and 1*b* that are united by the above-mentioned U-shaped web. In this case, the film 1 is preferably provided with a zone of weakness 1*d* at the web 1*c*, for example in the form of a pre-tear line or a perforated line, that is preferably centrally located.

The variant of FIG. 8 makes it possible to achieve sealing. Where appropriate, the line of perforations 1*d* could be covered with a sealing strip.

The link zones 150 and 152 can be obtained by heat sealing or by adhesive.

The sheets 1*a* and 1*b* shown in FIGS. 6, 7, and 8 may be open, that is they may be separated, by any appropriate means, so that the film 1 reaches the inlet to the forming neck in a substantially planar state.

FIGS. 9 to 12 show means designed to bond the tape 100 to the film 1. In these FIGS. 9 to 12, reference 200 designates a roll for conveying the film 1 with a 90° bend, reference 210 designates a heat-sealing blade, and reference 220 a backing blade.

In the implementations shown in FIGS. 9 to 12, the ends of the U-shaped tape 100 are folded outwardly, as at 100*a* and 100*b* through 90° so that the general shape of the tape 100 is a U-shape.

The web of the tape 100 is disposed in a complementary longitudinal groove 222 formed in the backing blade 220. The ends of the tape 100 define coplanar lengths 100*a* and 100*b* disposed between and facing adjacent faces of the heat-sealing blade 210 and the backing blade 220. The film 1 is also conveyed between the heat-sealing blade 210 and the backing blade 220, thereby enabling them to perform bonding between the film 1 and the lengths 100*a* and 100*b* of the tape 100, by applying pressure together with heat.

Figure 10:
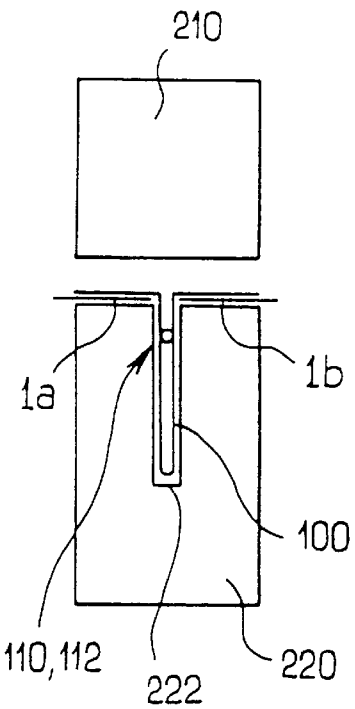
FIGS. 9 and 10 are respectively a side view and a cross-section view of means for providing bonding between the film and the flexible tape.
Figure 9:
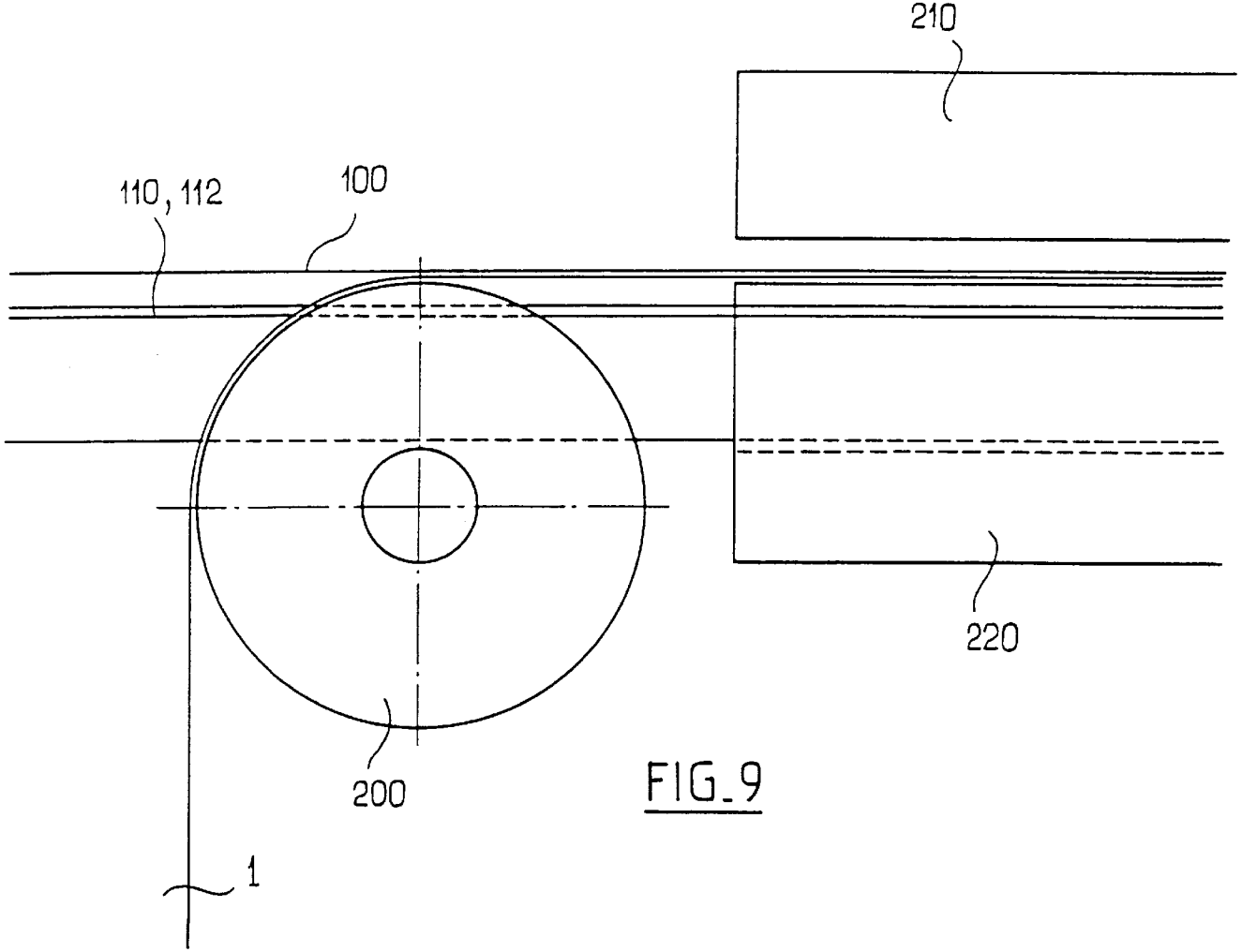

Still more precisely, in FIGS. 9 and 10, the roll 200 is disposed beneath the tape 100 that is folded into a T-shape. Consequently, the roll 200 includes an annular groove opening out into its periphery for passing the web of the tape 100. Also, in FIGS. 9 and 10, the film 1 is conveyed between the heat-sealing blade 210 and the backing blade 220 in the form of two separate lengths 1*a* and 1*b*.

Figures 11, 12:
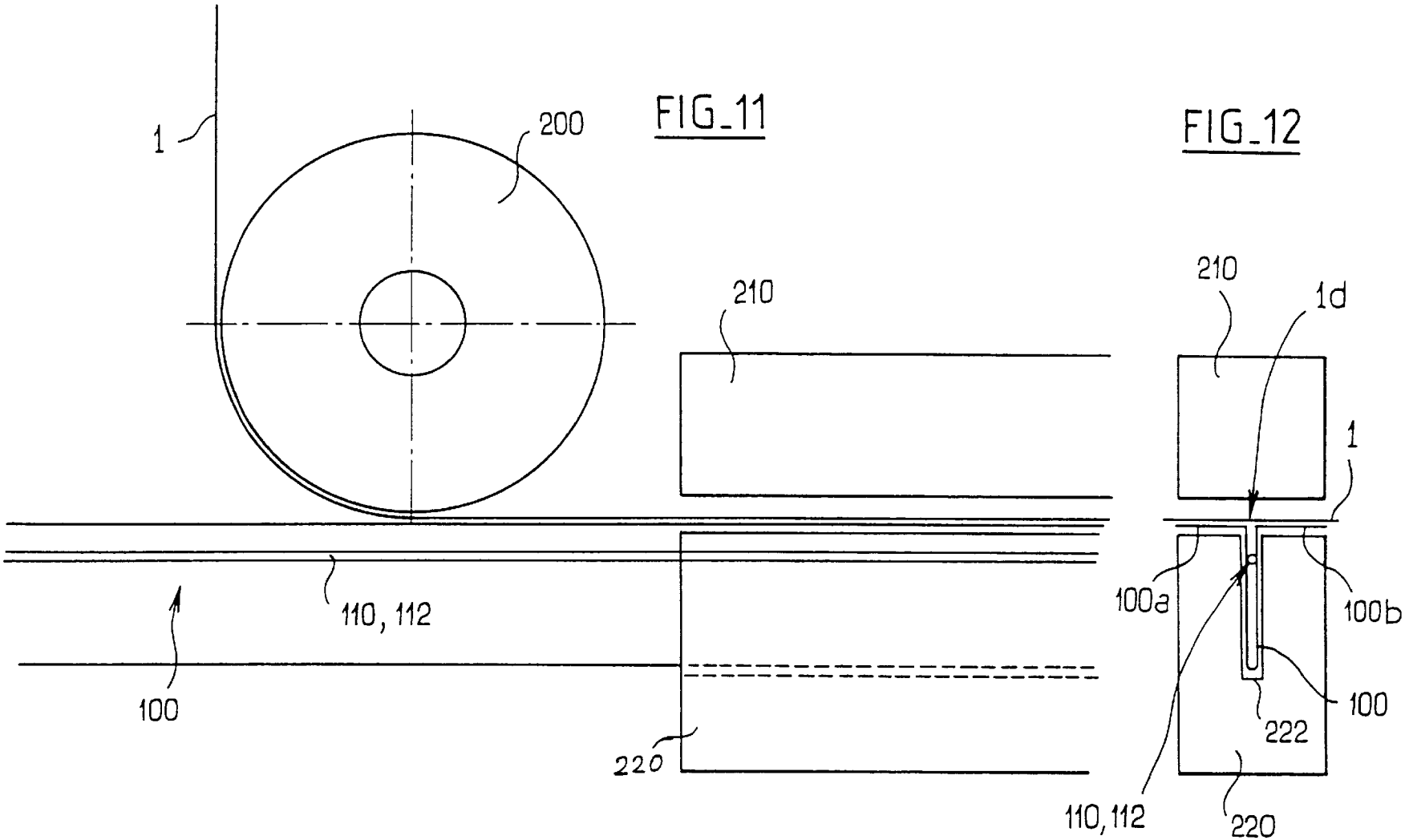
FIGS. 11 and 12 are view similar to those of FIGS. 9 and 10, respectively comprising a side view and a cross-section view of a variant embodiment of such means for providing bonding between the film and the flexible tape carrying the strips.

In FIGS. 11 and 12, the roll 200 is placed above the tape 100. In this case, the film 1 can be continuous and, where appropriate, it may be provided with tearable perforations or the equivalent id, as described above. Obviously, many modifications and variations of the present invention are possible in light of the above teachings. It is therefore to be understood that within the scope of the appended claims, the present invention may be practiced otherwise than as specifically described herein.

I claim:

1. A method of forming a packaging bag assembly, to be conducted toward a machine for automatically forming, filling, and closing reclosable packaging bags, formed from a film of flexible thermoplastic material and complementary male and female closure strips, comprising the steps of:

feeding a flexible thermoplastic film;

feeding a single flexible tape having opposite side edges and complementary male and female closure strips disposed upon said single flexible tape at positions laterally inset from said opposite side edges of said single flexible tape; and fixing said single flexible tape, comprising opposite side portions which are defined between said opposite side edges and said laterally inset complementary male and female closure strips, upon said flexible thermoplastic film, so as to fix said complementary male and female closure strips upon said flexible thermoplastic film, by heat sealing substantially only said opposite side portions of said single flexible tape, defined between said complementary male and female closure strips and said opposite sides edges, onto said flexible thermoplastic film prior to feeding the resulting packaging bag assembly, comprising said flexible thermoplastic film and said flexible tape, to a tube-forming neck of an automatic machine for forming, filling, and closing packaging bags.

2. A method according to claim 1, wherein:

said tape is folded over into a U-shape so as to form said tape into two wines wherein each one of said two wings of said tape has one of said complementary closure strips disposed thereon; and said complementary closure strips carried by said tape are engaged with each other while said tape is being fixed onto said thermoplastic film.

3. A method according to claim 2, wherein said fixing of said complementary male and female closure strips upon said flexible thermoplastic film comprises the steps of:

heat sealing a first one of said wings of said tape carrying said closure strips onto a first length of said thermoplastic film;

folding said thermoplastic film; and heat sealing a second one of said wings of said tape onto a second length of said thermoplastic film so as to form a Z-shape at a closure region of said packaging bag prior to feeding said packaging bag assembly comprising said thermoplastic film and said flexible tape to the tube-forming neck of an automatic machine for forming, filling, and closing packaging bags.

4. A method according to claim 1, wherein:

said tape carrying said closure strips is disposed in a planar state during the step of heat sealing said tape onto said thermoplastic film.

5. A method according to clam 4, wherein the assembly comprising the film and the tape is fed in said planer state to the forming neck, with the strips being moved progressively towards each other and brought into engagement in the forming neck.

6. A method according to claim 4, wherein the assembly comprising the film and the tape is deformed into a Z-shape so as to enable the strips to engage prior to being transferred to the forming neck.

7. A method according to claim 2, wherein the two wings of the tape are respectively heat sealed to two lengths of the film which are secured to each other.

8. A method according to claim 2, wherein the two wings of the tape are respectively heat sealed to two lengths of film which are separate from each other.

9. A method according to claim 1, wherein the film is made up of two parallel adjacent lengths during the step of fixing said closure strips there to.

10. A method according to claim 9, wherein the two lengths of the film are separate during the fixing step.

11. A method according to claim 9, wherein the two lengths are formed by a U-shaped fold in the film during the fixing step.

12. A method according to claim 11, wherein the U-shaped web of the film is placed in the U-shaped tape carrying the closure strips.

13. A method according to claim 12, wherein:

said thermoplastic film is provided with a zone of weakness within a region of said film disposed within said tape.

14. A method according to claim 2, wherein:

said thermoplastic film is folded into a U-shape such that free ends of said thermoplastic film folded into said U-shape are fixed respectively on said wings of said flexible tape; and said thermoplastic film is cut longitudinally before inserting it one the forming neck of the automatic machine.

15. A method according to claim 1, wherein:

said flexible tape carrying said closure strips has its free ends disposed at 90 with respect to a U-shaped web portion thereof in order to define a substantially T-shape during the step of being fixed to said thermoplastic film.

16. A method according to claim 2, further comprising the step of:

inserting a thermally insulating spacer between said wings of said tape folded into said U-shape prior to said heat sealing of said tape onto said film.

17. A method according to claim 2, wherein the tape is heat sealed to the film by means of a inside surfaces of its wings.

18. A method according to claim 2, wherein the tape is heat sealed onto the film by means of outside surfaces of its wings.

19. An automatic machine for forming, filling, and closing reclosable packaging bags, formed from a film of flexible thermoplastic material having complementary male and female closure strips disposed thereon, comprising:

a tube-forming neck for forming a film of thermoplastic material, fed thereto in a planar state, into a tube;

means for supplying a flexible thermoplastic film;

means for supplying a single flexible tape having opposite side edges and complementary male and female closure strips disposed upon said single flexible tape at positions laterally inset from said opposite side edges of said single flexible tape; and means for fixing said single flexible tape, comprising opposite side portions which are defined between said opposite side edges and said laterally inset complementary male and female closure strips, upon said flexible thermoplastic film, so as to fix said complementary male and female closure strips upon said flexible thermoplastic film, by heat sealing substantially only said opposite side portions of said single flexible tape, defined between said complementary male and female closure strips and said opposite sides edges, onto said flexible thermoplastic film prior to feeding the resulting packaging bag assembly, comprising said flexible thermoplastic film and said flexible tape, to said tube-forming neck of said automatic machine.

20. A machine according to claim 19, further comprising:

means for folding said flexible tape into a U-shape such that two wings of said tape are respectively defined within the vicinity of each one of said complementary closure strips; and means for mutually engaging said complementary closure strips during fixing of said flexible tape onto said film.

21. A machine according to claim 20, further comprising:

means for heat sealing a first one of said wings of said tape provided with said closure strips onto a first length of said thermoplastic film;

means for folding said thermoplastic film and means for heat sealing a second one of said wings of said tape onto a second length of said thermoplastic film so as to form a Z-shape at a closure region of said packaging bag prior to feeding said packaging bag assembly comprising said thermoplastic film and said flexible tape to said tube-forming neck of said automatic machine.

22. A machine according to claim 19, wherein:

said flexible tape is disposed in a planar state while said flexible tape is being heat sealed onto said thermoplastic film.

23. A machine according to claim 22, further comprising:

means for conveying said packaging bag assembly comprising said thermoplastic film and said flexible tape in said planar state to said tube-forming neck; and means for progressively moving said closure strips towards each other and for bringing them into engagement with each other within said tube-forming neck.

24. A machine according to claim 19, further comprising:

means for deforming said packaging bag assembly comprising said thermoplastic film and said flexible tape into a Z-shape so as to bring said closure strips into engagement prior to being transferred to said tube-forming neck.

25. A machine according to claim 20, wherein the two wings of the tape are heat sealed respectively to two lengths of the film which are secured to each other.

26. A machine according to claim 20, wherein the two wings of the tape are heat sealed respectively to two lengths of the film which are separate from each other.

27. A machine according to claim 19, further comprising:

a filling chute which opens into said tube-forming neck and consequently into said film tube;

longitudinal heat sealing means for sealing together longitudinal edges of said film in order to close said film tube longitudinally; and means for sequentially generating a first transverse line of heat sealing prior to a product being deposited within said film tube through said filling chute, and a second transverse line of heat sealing after a product has been deposited within said film tube, in order to close said packaging bag around product.

28. A machine according to claim 20, further comprising a thermally insulating spacer adapted to be inserted between the two wings of the tape during the heat sealing operations.

29. A machine according to claim 19, wherein said means for fixing said tape on said film comprises:

a heat-sealing blade; and a backing blade having a longitudinal groove defined therein for receiving said tape which is folded so as to have a substantially T-shaped configuration.

30. A method as set forth in claim 13, wherein:

said zone of weakness is provided in the form of tearable perforations.

* * * * *